US007568575B2

(12) United States Patent
Kalantari

(10) Patent No.: US 7,568,575 B2
(45) Date of Patent: Aug. 4, 2009

(54) ENGINE SUPPORT SYSTEM

(75) Inventor: Amir M. Kalantari, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 204 days.

(21) Appl. No.: 11/500,682

(22) Filed: Aug. 8, 2006

(65) Prior Publication Data

US 2009/0173251 A1 Jul. 9, 2009

Related U.S. Application Data

(60) Provisional application No. 60/796,248, filed on Apr. 28, 2006.

(51) Int. Cl.
*B65G 17/32* (2006.01)

(52) U.S. Cl. ..... 198/687; 198/680; 198/685

(58) Field of Classification Search ..... 198/680, 198/681, 685, 687
See application file for complete search history.

(56) References Cited

U.S. PATENT DOCUMENTS

| | | | | |
|---|---|---|---|---|
| 2,212,695 | A | | 8/1940 | Nash |
| 2,902,945 | A | | 9/1959 | Simon |
| 2,988,012 | A | | 6/1961 | Markley et al. |
| 3,132,598 | A | | 5/1964 | Pearson |
| 3,313,014 | A | | 4/1967 | Lemelson |
| 3,561,365 | A | | 2/1971 | Rooklyn |
| 3,786,942 | A | | 1/1974 | Dane, Jr. |
| 3,814,023 | A | * | 6/1974 | Stantial ..... 104/94 |
| 3,926,303 | A | * | 12/1975 | McCall ..... 198/687.1 |
| 3,927,760 | A | | 12/1975 | McCall |
| 4,053,189 | A | | 10/1977 | Novotny |
| 4,069,764 | A | | 1/1978 | Teyssedre |
| 4,395,180 | A | | 7/1983 | Magnotte |
| 4,467,911 | A | * | 8/1984 | Forshee ..... 198/867.15 |
| 4,821,217 | A | | 4/1989 | Jackson et al. |
| 4,925,015 | A | * | 5/1990 | Vaida et al. ..... 198/803.7 |
| 5,119,732 | A | | 6/1992 | Lisy |
| 5,321,874 | A | | 6/1994 | Mills et al. |
| 5,361,890 | A | * | 11/1994 | McDonald et al. ..... 198/465.4 |
| 5,363,770 | A | * | 11/1994 | Makimura et al. ..... 104/172.5 |
| 5,819,906 | A | * | 10/1998 | Enderlein et al. ..... 198/687.1 |
| 6,321,657 | B1 | | 11/2001 | Owen |
| 6,745,454 | B1 | | 6/2004 | Grimshaw et al. |
| 7,334,527 | B2 | * | 2/2008 | Waldmiller ..... 105/148 |

* cited by examiner

*Primary Examiner*—Douglas A Hess
(74) *Attorney, Agent, or Firm*—Kinney & Lange, P.A.

(57) ABSTRACT

A production apparatus includes a generally overhead track, a vertically adjustable link assembly supported from the track by one or more trolleys, a substantially horizontally oriented build beam attached to the link assembly opposite the track, a set of first and second cross beams extending from opposite sides of the build beam, and a set of third and fourth cross beams extending from opposite sides of the build beam. A set of first and second connectors are attached to the set of first and second cross beams, respectively, and are configured for attachment to a workpiece. A set of third and fourth connectors are attached to the set of third and fourth cross beams, respectively, and are configured for attachment to a workpiece. The first, second, third and fourth cross beams are each generally perpendicular to the build beam.

22 Claims, 3 Drawing Sheets

ENGINE SUPPORT SYSTEM

CROSS-REFERENCE TO RELATED APPLICATION(S)

This application claims priority from U.S. Provisional Patent Application Ser. No. 60/796,248, filed Apr. 28, 2006, for ADJUSTABLE LINK SYSTEM AND MULTIPURPOSE ENGINE SUPPORT/BUILD BEAM by Amir Kalantari, which is herein incorporated by reference in its entirety.

BACKGROUND OF THE INVENTION

The present invention relates to load supporting structures.

During the assembly of gas turbine engines, it is common to conduct assembly operations along an engine pack line, which resembles an assembly line. First, engine modules are built and placed on pedestals. The engine modules are then lifted into position for attachment to an engine core by cable hoists and pulleys suspended from an overhead track. As assembly operations progress, the partially assembled engine and its modules require a great deal of pick-up and moving operations with the hoists and pulleys. The pedestals can get in the way of workers. In short, these operations are time consuming and present safety issues. A key safety issue is the presence of large (about 7,257 kg or 16,000 lbs.) loads suspended in a temporary fashion from hoists and pulleys using cable, chain and hooks. This poses risks to workers around or under the engine, who can be hurt if the engine, or a part of it, falls from the hoists, pulleys, and hooks.

BRIEF SUMMARY OF THE INVENTION

A production apparatus includes a generally overhead track, a vertically adjustable link assembly supported from the track by one or more trolleys, a substantially horizontally oriented build beam attached to the link assembly opposite the track, a set of first and second cross beams extending from opposite sides of the build beam, and a set of third and fourth cross beams extending from opposite sides of the build beam. A set of first and second connectors are attached to the set of first and second cross beams, respectively, and are configured for attachment to a workpiece. A set of third and fourth connectors are attached to the set of third and fourth cross beams, respectively, and are configured for attachment to a workpiece. The first, second, third and fourth cross beams are each generally perpendicular to the build beam.

DETAILED DESCRIPTION

The present invention relates to an engine support system and engine assembly method that utilizes a support beam assembly suspended from an overhead support assembly and pivotally attached by rigid connectors to components of an engine being assembled. Typically, the support beam assembly is suspended from an overhead track by two or more adjustable linking assemblies. The engine is supported below the support beam assembly in order to facilitate assembly operations. The support beam assembly generally remains attached to the engine throughout the assembly process. The support beam assembly includes an adjustable auxiliary beam to facilitate lifting tooling and other components relative to the engine being assembled.

Figure 1:
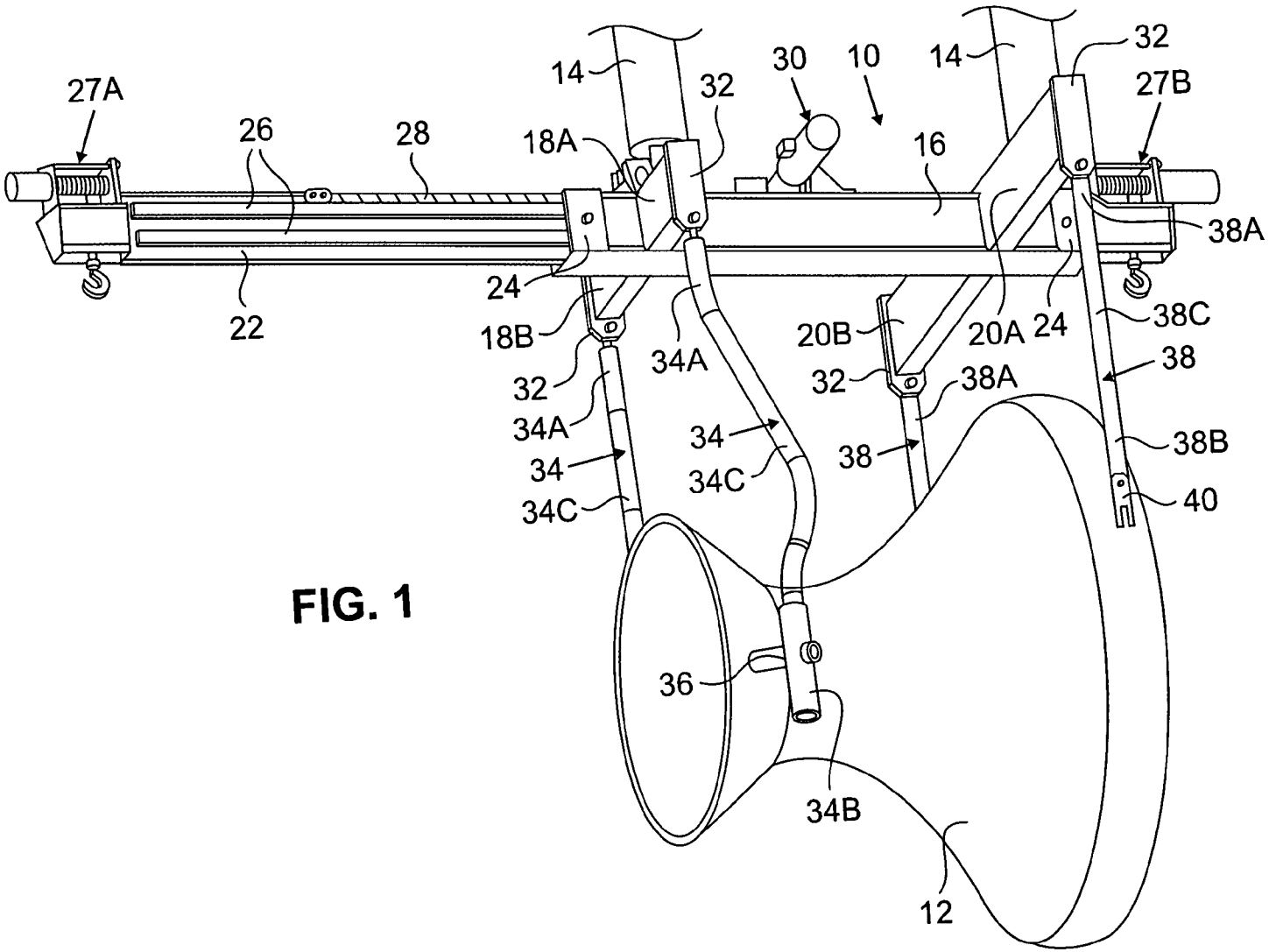
FIG. 1 is a perspective view of a support beam assembly according to the present invention attached to an engine core.

FIG. 1 is a perspective view of a support beam assembly 10 attached to a gas turbine engine core 12 (the engine core 12 is shown in a simplified schematic manner in FIG. 1) and suspended from a pair of adjustable link assemblies 14. The support beam assembly includes a central beam 16, a first set of cross beams 18A and 18B (collectively, the first set of cross beams 18), a second set of cross beams 20A and 20B (collectively, the second set of cross beams 20), and an auxiliary beam 22.

Figure 4:
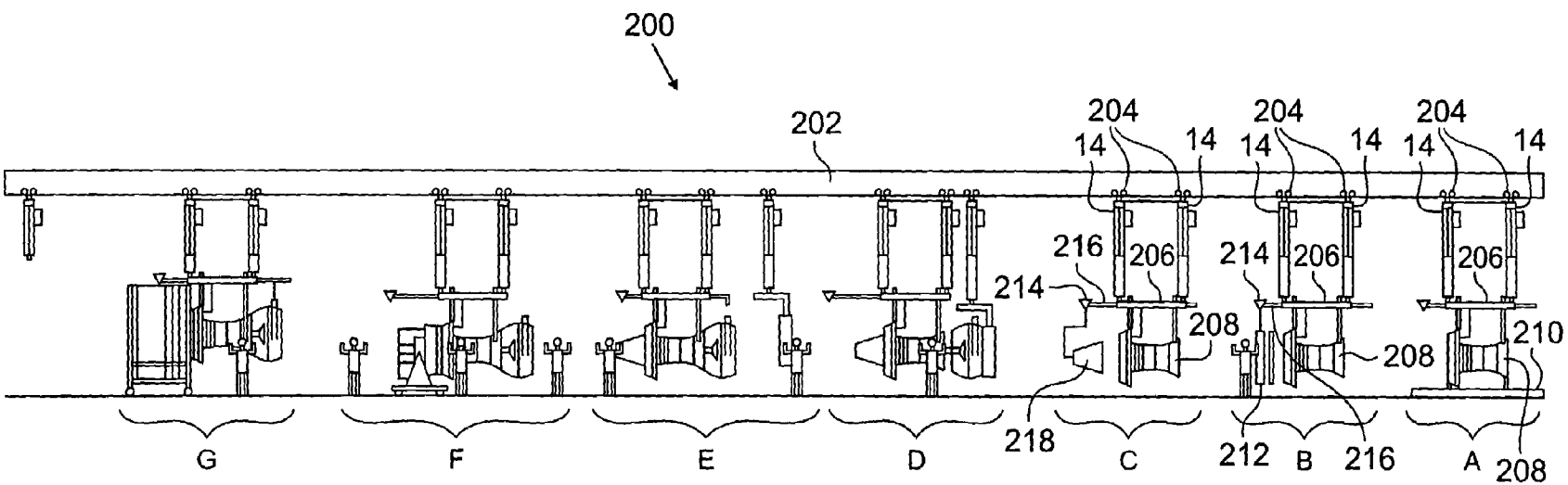
FIG. 4 is a schematic illustration of an engine support system utilizing support beam assemblies.

The adjustable link assemblies 14 are located in a generally overhead position, and can be supported from an overhead track on trolleys (see FIG. 4). Suitable adjustable link assemblies include those described in U.S. Pat. App. Pub. No. 2007/0261227, entitled "Adjustable Link System", filed on even date herewith and hereby incorporated by reference in its entirety, as well as conventional commercially available screw jacks such as those available from Duff-Norton, Charlotte, N.C. The adjustable link assemblies 14 have a variable vertical length, which enables vertical adjustment suspended support beam assembly 10. The adjustable link assemblies 14 are attached to the central beam 16 relative to the center of gravity of the engine being assembled, to better balance loads supported by the support beam assembly 10. However, it should be noted that the center of gravity may vary slightly during the course of engine assembly, and the center of gravity will vary according to the particular type of engine being assembled.

The central beam (or build beam) 16 is the main structure of the assembly 10, and is the part to which the adjustable link assemblies 14 are attached with bolts or other suitable fasteners. The central beam 16 is tubular in shape, and in the illustrated embodiment has an elongate, rectangular tube shape. Roller assemblies 24 are located at opposite ends of the central beam 16, having rollers positioned at the interior of the central beam 16 to support the auxiliary beam 22 in a movable relationship with respect to the central beam 16. The central beam 16, as well as the other beams of the assembly 10, can be made of a suitable metallic material (e.g., steel) to support desired loads with an adequate safety margin.

The auxiliary beam 22 is an elongate beam that extends through the interior of the central beam 16. In the illustrated embodiment, the auxiliary beam 22 is a straight, rectangular tubular member made of a metallic material (e.g., steel), although in alternative embodiments the auxiliary beam 22 can have other shapes. The auxiliary beam 22 has a pair of parallel rails 26 disposed on each side (only one pair of rails 26 is visible in FIG. 1) to engage the rollers of the roller assemblies 24 on the central beam 16. The rails 26 can be machined into the auxiliary beam 22. First and second hoist assemblies 27A and 27B, respectively, are located at opposite ends of the auxiliary beam 22. The first and second hoist assemblies 27A and 27B are conventional cable or chain hoists that are capable of lifting at least about 272 kg (600 lbs.) with a suitable safety factor (e.g., with a 5× safety factor). A screw-type threaded drive shaft 28 is attached to the auxiliary beam 22, and the drive shaft 28 is driven by a motor assembly 30 mounted on the central beam 16. Driving the motor assembly 30 induces movement of the auxiliary beam 22 via the drive shaft, which allows horizontal, longitudinal adjustment. The motor assembly 30 can be a conventional electric motor with suitable gearing to engage the threads of the drive shaft 28. Alternatively, a chain drive or other suitable drive system can be used in further embodiments. Control of the motor assembly 30 can be achieved using a conventional remote control (not shown), which can operate by radio frequency (RF) or other remote communication means.

The auxiliary beam 22 can be used to support engine modules, tooling, and other items used during the assembly of engines. The hoist assemblies 27A and 27A at either end of the auxiliary beam 22 can be used to raise and lower items into desired positions. Moreover, the motor assembly 30 and drive shaft 28 can be used to horizontally position the auxiliary beam 22 with respect to the engine core 12 (or other item supported by the assembly 10) as desired. The engine core 12 and the central beam 16 can remain static while the auxiliary beam 22 is adjusted, allowing items supported by one or both hoist assemblies 27A and 27B to be horizontally repositioned for use in assembly operations. This can reduce the need to move the large, heavy engine core 12 at any components of engine modules already attached to the engine core 12 during assembly.

In the embodiment shown in FIG. 1, the first and second sets of cross beams 18 and 20 each extend laterally from the central beam 16, that is, horizontally at approximately 90° with respect to the central beam 16. It should be noted that the first and second sets of cross beams 18 and 20 can be arranged differently (e.g., at angles other than 90° with respect to the central beam 16) in alternative embodiments. Attachment brackets 32 are located at opposite ends of both the first and second sets of cross beams 18 and 20.

A pair of first support links (or connectors) 34 are pivotally suspended from each of the attachment brackets 32 of the first set of cross beams 18. Each first support link 34 is a rigid tubular member having an upper end 34A, a lower end 34B and a middle portion 34C, with the upper ends 34A being connected to attachment brackets 32. The middle portion 34C of the first support links 34 have a curved shape so as to provide additional space for engine components. However, the upper and lower ends 34A and 34B are substantially vertically aligned, so as not to produce any moment on engine components supported by the support beam assembly 10. Moments can stress engine components during assembly, and are generally undesired. As shown in FIG. 1, the engine core 12 is pivotally connected to the lower ends 34B of the first support links 34 with pin and spherical ball joint assemblies 36 (on one visible in FIG. 1), which permit pivotal movement of the engine core 12 with respect to the support beam assembly 10 in at least two directions. It should be noted that other types of connection assemblies can be used to connect the engine core 12 to the first support links 34 in alternative embodiments. Moreover, the particular shape and design of the first support links 34 can vary as desired to accommodate the configurations of particular engines supported by the support beam assembly 10.

A pair of second support links (or connectors) 38 are pivotally suspended from the attachment brackets 32 of the second set of cross beams 20. The second support links 38 are substantially solid, rigid beams each having an upper end 38A, a lower end 38B and a middle portion 38C, and the second support links 38 each have a substantially straight shape. That straight shape substantially vertically aligns the upper and lower ends 38A and 38B, so that the second support links 38 do not to produce any moment on engine components supported by the support beam assembly 10. As shown in FIG. 1, the engine core 12 is pivotally connected to the lower ends 38B of the second support links 38 with pin and two-way pivot assemblies 40 (only one visible in FIG. 1), which permit pivotal movement of the engine core 12 with respect to the support beam assembly 10 in two directions. It should be noted that other types of connection assemblies can be used to connect the engine core 12 to the second support links 38 in alternative embodiments. Moreover, the particular shape and design of the second support links 38 will vary to accommodate the configurations of particular engines to be supported with the support beam assembly 10.

The first and second pairs of support links 34 and 38 are attached to the engine core 12 at designated connection points on the engine core 12, which are typically locations on an engine case portion. That is, the engine core 12 is connected to the support beam assembly 10 at suitable locations so that the engine is balanced during assembly and so that the engine is not damaged. It should be noted that although a gas turbine engine core is supported by the support beam assembly 10 in FIG. 1, other types of engine and other structures can also be supported by the assembly 10.

The support beam assembly 10 is configured to support engines having a total weight of about 7,257 kg (16,000 lbs.) with a suitable safety margin (e.g., a 5× safety margin). The engine is supported in a relatively rigid and balanced manner, and the support beam assembly 10 is configured to avoid placing any moments on the engine while being assembled. However, pivotal connections are provided with the support beam assembly 10, as described above with respect to assemblies 36 and 40, so that about 9-11° of "swing" is provided to avoid the abrupt transmission of forces that could otherwise cause damage to the engine being assembled or cause damage to the support beam assembly 10 by snapping one or more of the supports 34 and 38.

Figure 2:
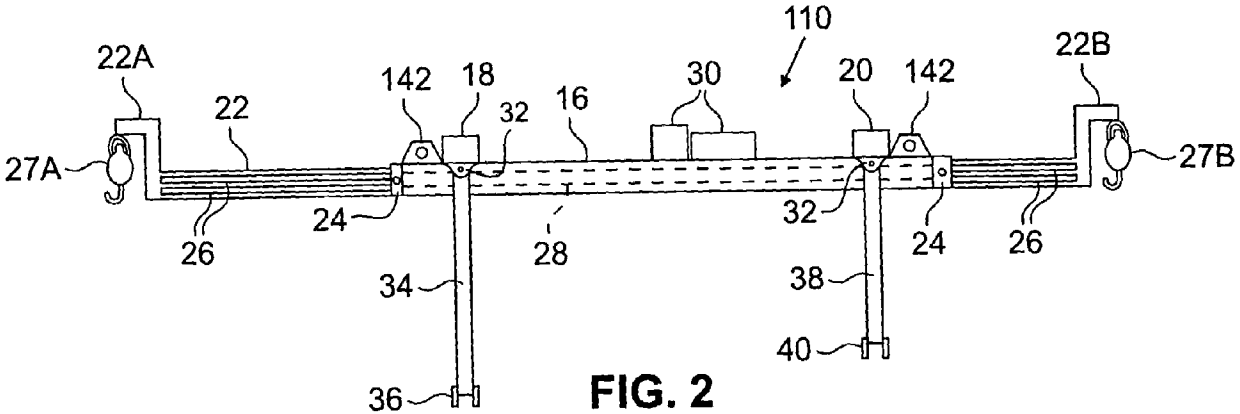
FIG. 2 is a side view of another embodiment of a support beam assembly.
Figure 3:
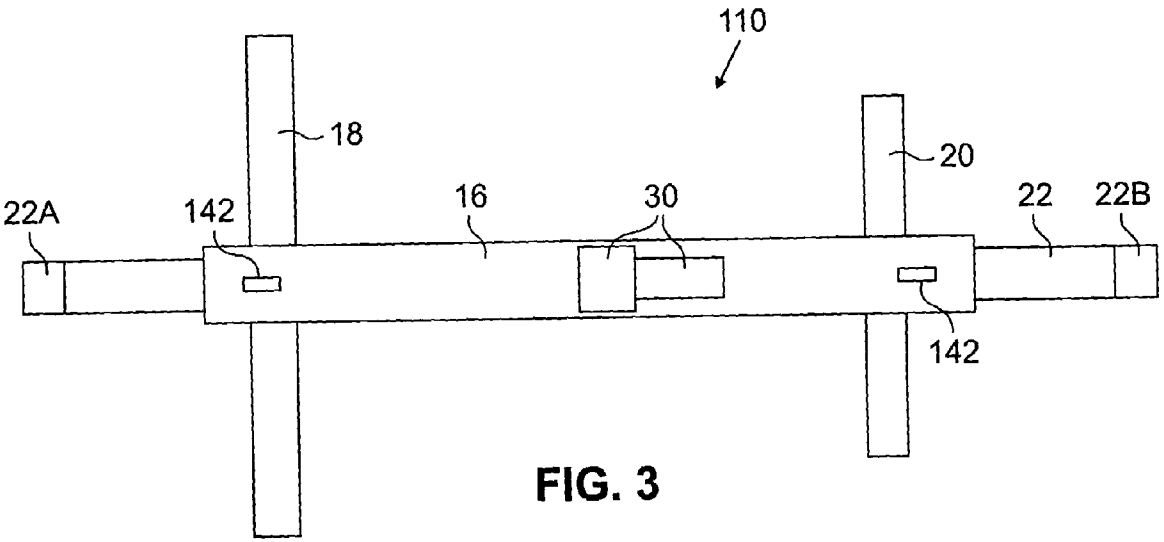
FIG. 3 is a top view of the support beam assembly of FIG. 2.

FIGS. 2 and 3 illustrate another embodiment of a support beam assembly 110. FIG. 2 is a side view, and FIG. 3 is a top view. The support beam assembly 110 is generally similar to the assembly 10 shown in FIG. 1. However, as shown in FIGS. 2 and 3, the auxiliary beam 22 has first and second raised ends 22A and 22B to which the hoists 27A and 27B are attached. Moreover, attachment structures 142 are located at the top of the central beam 16 of the support beam assembly 110, to enable attachment of overhead supports (e.g., adjustable link assemblies like those shown in FIG. 1). The attachments structures 142 are located relative to the center of gravity of the engine being assembled, to better balance loads supported by the support beam assembly 110.

FIG. 4 is a schematic illustration of an engine support system 200 that includes an overhead monorail track 202 and assembly stations A-G located along the track 202. As shown in FIG. 4, engines in various assembly states are shown at each station. However, those skilled in the art will recognize that typically only a single engine will be supported from a particular track at a given time. Moreover, those skilled in the art will recognize that the particular modules, components, and tooling utilized by workers at any particular station can vary. In that respect, the assembly operations shown in FIG. 4 and described herein are provided by merely way of example, and not limitation.

Turning first to station A, a pair of adjustable links 14 are suspended from the track 202 by conventional trolleys 204. A support beam assembly 206, like those shown and described with respect to FIGS. 1-3, is bolted to the adjustable links 14. A gas turbine engine core 208 is attached to support beam assembly 206 at station A, and various assembly procedures can be performed. The engine core 208 is lifted from a platform 210, where the core 208 originally rested.

At stations B-G, additional assembly operations are performed. Typically, the trolleys 204 are moved along the track 202 sequentially to all the stations A-G in order to assembly the engine. Thus, the trolleys 204, the adjustable links 14, the support beam assembly 206 and attached engine core 208 are moved along the track from station A to station B, where tooling 212 is moved into place with a first hoist 214 on an auxiliary beam 216 of the support beam assembly 206. Various assembly operations are performed at station B utilizing the tooling 212. The first hoist 214 lifts relatively lightweight items while the engine core 208 is stationary along the track 202. Horizontal adjustment of the auxiliary beam 216 and vertical adjustment of the first hoist 214 allow convenient adjustment of the tooling 212 without having to move the relatively heavy engine core 208.

Next, the trolleys 204, the adjustable links 14, the support beam assembly 206 and attached engine core 208 are moved along the track 202 to station C. There, a first engine module 218 is lifted into place with the first hoist 214 and attached to the engine core 208. The auxiliary beam 216 can be adjusted horizontally to accommodate attachment of the first engine module 218 to the engine core 208, and the adjustable links 14 can likewise be adjusted vertically.

Similar assembly processes are performed at stations D-G (references number are omitted at stations D-G for simplicity). Then, when assembly is complete, the completed engine (i.e., the engine core 208 with all desired engine modules and engine components installed thereupon) is detached from the support beam assembly 206 and can be transported away from the assembly facility for eventual installation on an aircraft.

It will be understood that the present invention provides numerous advantages. For example, the support beam assembly provides a relatively fixed connection to an engine during assembly, which eliminates the need to suspend the engine from cable or chain hoists while being moved along a track. Moreover, in providing better, more secure connections to the engine through rigid members of the support beam assembly, a safer work environment is provided for workers assembling engines.

Although the present invention has been described with reference to preferred embodiments, workers skilled in the art will recognize that changes may be made in form and detail without departing from the spirit and scope of the invention. For instance, the particular size, shape and configuration of the support beam assembly according to the present invention will vary according to the particular application (e.g., the particular type of engine being assembled). In addition, it should be recognized that features such as the auxiliary support beam are optional and may be omitted in various embodiments.

What is claimed is:

1. A production apparatus comprising:

a track that enables trolleys to be operably engaged thereto, the track located in a generally overhead position;

a link assembly supported from the track by one or more trolleys attached thereto, the link assembly being adjustable in length in a vertical dimension;

a build beam attached to the link assembly opposite the track, the build beam having a substantially horizontal orientation;

a set of first and second cross beams extending from opposite sides of the build beam and each being generally perpendicular to the build beam;

a set of third and fourth cross beams extending from opposite sides of the build beam and each being generally perpendicular to the build beam;

a set of first and second connectors attached to the set of first and second cross beams, respectively, and configured for attachment to a workpiece positioned below the build beam, wherein the set of first and second connectors extend generally vertically;

a set of third and fourth connectors attached to the set of third and fourth cross beams, respectively, and configured for attachment to a workpiece positioned below the build beam, wherein the set of third and fourth connectors extend generally vertically; and an auxiliary support beam positioned to extend though the build beam in a horizontal direction, the auxiliary support beam supported relative the build beam by a roller and track assembly to permit horizontal adjustment with respect to the build beam, and wherein the auxiliary support beam defines a first and a second end.

2. The apparatus of claim 1, wherein the link assembly includes a first link and a second link.

3. The apparatus of claim 2, wherein the first and second links are each screw-drive type adjustable links.

4. The apparatus of claim 3, wherein the screw-drive type links are operable via remote control.

5. The apparatus of claim 1, wherein the set of first and second connectors are attached to the set of first and second cross beams with spherical ball joint connectors.

6. The apparatus of claim 1, wherein the set of third and fourth connectors are attached to the set of third and fourth cross beams with spherical ball joint connectors.

7. The apparatus of claim 1, wherein each of the first and second connectors defines an upper end, a lower end, and a middle portion, and wherein the middle portion has a non-linear shape, and wherein the upper and lower ends are positioned so as to be substantially vertically aligned.

8. The apparatus of claim 1, wherein each of the third and fourth connectors defines an upper end, a lower end, and a middle portion, and wherein the middle portion has a linear shape, and wherein the upper and lower ends are positioned so as to be substantially vertically aligned.

9. The apparatus of claim 1, wherein the track is a monorail track.

10. The apparatus of claim 1 and further comprising:

an auxiliary screw-drive assembly for horizontally adjusting the auxiliary support beam with respect to the build beam.

11. The apparatus of claim 1 and further comprising:

a first hoist assembly mounted at the first end of the auxiliary support beam.

12. The apparatus of claim 11 and further comprising:

a second hoist assembly mounted at the second end of the auxiliary support beam.

13. A production apparatus comprising:

a track that enables trolleys to be operably engaged thereto, the track located in a generally overhead position;

a link assembly supported from the track by one or more trolleys attached thereto, the link assembly being adjustable in length in a vertical dimension, wherein the link assembly includes a first screw-drive type adjustable link and a second screw-drive type adjustable link, and wherein the first and second screw-drive type adjustable links are operable via remote control;

a build beam attached to the link assembly opposite the track, the build beam having a substantially horizontal orientation;

a set of first and second cross beams extending from opposite sides of the build beam and each being generally perpendicular to the build beam;

a set of third and fourth cross beams extending from opposite sides of the build beam and each being generally perpendicular to the build beam;

a set of first and second connectors attached to the set of first and second cross beams, respectively, and configured for attachment to a workpiece positioned below the build beam, wherein the set of first and second connectors extend generally vertically; and a set of third and fourth connectors attached to the set of third and fourth cross beams, respectively, and configured for attachment to a workpiece positioned below the build beam, wherein the set of third and fourth connectors extend generally vertically.

14. The apparatus of claim 13, wherein the set of first and second connectors are attached to the set of first and second cross beams with spherical ball joint connectors.

15. The apparatus of claim 13, wherein the set of third and fourth connectors are attached to the set of third and fourth cross beams with spherical ball joint connectors.

16. The apparatus of claim 13, wherein each of the first and second connectors defines an upper end, a lower end, and a middle portion, and wherein the middle portion has a non-linear shape, and wherein the upper and lower ends are positioned so as to be substantially vertically aligned.

17. The apparatus of claim 13, wherein each of the third and fourth connectors defines an upper end, a lower end, and a middle portion, and wherein the middle portion has a linear shape, and wherein the upper and lower ends are positioned so as to be substantially vertically aligned.

18. The apparatus of claim 13, wherein the track is a monorail track.

19. The apparatus of claim 13 and further comprising:

an auxiliary support beam positioned to extend though the build beam in a horizontal direction, the auxiliary support beam supported relative the build beam by a roller and track assembly to permit horizontal adjustment with respect to the build beam, and wherein the auxiliary support beam defines a first and a second end.

20. The apparatus of claim 19 and further comprising:

an auxiliary screw-drive assembly for horizontally adjusting the auxiliary support beam with respect to the build beam.

21. The apparatus of claim 19 and further comprising:

a first hoist assembly mounted at the first end of the auxiliary support beam.

22. The apparatus of claim 21 and further comprising:

a second hoist assembly mounted at the second end of the auxiliary support beam.

* * * * *